US006904247B2

(12) United States Patent
Yoon et al.

(10) Patent No.: US 6,904,247 B2
(45) Date of Patent: Jun. 7, 2005

(54) HIGH VOLTAGE SWITCHING EQUIPMENT OF DEVELOPING DEVICE FOR COLOR IMAGE FORMING APPARATUS

(75) Inventors: Young-min Yoon, Yongin (KR); Se-hyun Lyu, Seoul (KR); Byeong-hwa Ahn, Yongin (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/422,992

(22) Filed: Apr. 25, 2003

(65) Prior Publication Data

US 2004/0005165 A1 Jan. 8, 2004

(30) Foreign Application Priority Data

Jul. 3, 2002 (KR) ..... 2002-38467

(51) Int. Cl.[7] ..... G03G 15/00
(52) U.S. Cl. ..... 399/88; 399/90
(58) Field of Search ..... 335/220; 399/53–55, 399/78, 88, 90, 222, 223, 225–229

(56) References Cited

U.S. PATENT DOCUMENTS 5,521,693 A * 5/1996 Kojima et al. ..... 399/228

FOREIGN PATENT DOCUMENTS

JP 06317981 A * 11/1994 ..... G03G/15/08
JP 11160973 A * 6/1999 ..... G03G/15/06

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

A high voltage switching equipment for sequentially supplying a high voltage to color developing devices, for developing an electrostatic latent image formed on a photoconductive medium of a color image forming apparatus using color toners includes high voltage applying terminals respectively formed in rear ends of fixed color developing devices contacting the photoconductive medium through a nip, a high voltage applying substrate, within which a high voltage circuit is installed, on which connector terminal strips connected to the each high voltage applying terminal are provided on one side, and on which first terminal strips connected to the high voltage circuit and second terminal strips connected to the connector terminal strips are arranged in pairs on the other side with a constant distance, and a high voltage connecting unit connecting the first terminal strips and the second terminal strips arranged on the high voltage applying substrate, so that the high voltage is supplied to a relevant developing device.

20 Claims, 4 Drawing Sheets

HIGH VOLTAGE SWITCHING EQUIPMENT OF DEVELOPING DEVICE FOR COLOR IMAGE FORMING APPARATUS

CROSS-REFERENCE TO RELATED APPLICATIONS

This application claims the benefit of Korean Patent Application No. 2002-38467, filed Jul. 3, 2002, in the Korean Intellectual Property Office, the disclosure of which is incorporated herein by reference.

BACKGROUND OF THE INVENTION

1. Field of the Invention

The present invention relates to an electrophotographic color image forming apparatus, and more particularly to a high voltage switching equipment sequentially supplying a high developing voltage (referred to as a 'high voltage' hereinafter) to color developing devices which develop an electrostatic latent image on a photoconductive medium using toner.

2. Description of the Related Art

For example, an electrophotographic color image forming apparatus, such as a color laser printer, a duplicating machine, etc., sequentially develops an electrostatic latent image on a photoconductive medium using color developing devices, i.e., a yellow toner developing device, a magenta toner developing device, a cyan toner developing device and a black toner developing device, and then transcribes and prints a visible image on a paper.

In a printing process mentioned above, a developing process adopts a method where a toner of a developing device is transferred to a photoconductive medium by a voltage difference between the photoconductive medium and the developing device and in order to perform such method, a high voltage should be supplied to one selected developing device or the above four color developing devices in sequence.

A typical example for a high voltage switching equipment of a developing device, adopted in a general electrophotographic color image forming apparatus, is illustrated in FIGS. 1 and 2, which will be briefly described in the following.

In FIGS. 1 and 2, the high voltage switching equipment includes a photoconductive drum 80, a developing device 82, a driving unit 83. Before description, it should be noted that a general color image forming apparatus has four color developing devices as shown in FIG. 1. Since the four developing devices have the same structure and operate in the same manner, description for only one developing device will be made for convenience.

As shown in FIG. 1, the four developing devices 82 are installed to contact the photoconductive drum 80 selectively or sequentially. Such respective developing device 82 has a developing roller 90 and a toner supplying roller 92 as shown in FIG. 2.

The driving unit 83 has a motor 86 and a cam 84 and is disposed in a rear end of each developing device 82. The driving unit 83 moves a relevant developing device 82 back and forth with respect to a side of the photoconductive drum 80, thereby the developing roller 90 become close on the photoconductive drum 80 so that toner on the developing roller 90 is transferred to the photoconductive drum 80. A curved contact 94 is disposed at the rear end of each developing device 82 to contact the cam 84 of the driving unit 83.

In the meantime, a high voltage terminal 88 generating a voltage difference necessary for development at the photoconductive drum 80 and the developing roller 90 is fixedly installed in a frame not shown. Therefore, when the developing device 82 is moved forth toward the side of the photoconductive drum 80 by the driving unit 83, a shaft of the developing roller 90 and the high voltage terminal 88 come in contact with each other, whereby the high voltage is supplied and the toner on a relevant developing device 82 is transferred to the photoconductive drum 80. After that, the developing device 82 is moved back by a restoring spring installed in its rear end, and another developing device 82 is moved forth by the driving unit 83, whereby development by toner of another color is performed. By such series of successive operations, the color developing devices are moved back and forth in sequence and the electrostatic latent image on the photoconductive drum 80 is developed using the color toners.

But the above-mentioned general high voltage switching equipment for the developing device adopted in the color image forming apparatus, operates in a manner such that the developing device 82 is moved back and forth with respect to the side of the photoconductive drum 80 using the driving unit 83 having the motor 86 and the cam 84. Accordingly, vibration due to a movement of the developing device 82 and a load variation upon a rotation of the photoconductive drum 80 are generated since the developing device 82 contacts the photoconductive drum 80 periodically. Such factors cause a change in a velocity of the photoconductive drum 80 in the long run, thereby generating a jitter that is fatal to an image quality of a color image.

Further, the above mentioned high voltage switching equipment of a conventional movement type developing device maintains a proper developing nip to obtain a stable image quality only if a movement distance of the developing device is always constant. But when the movement distance of the driving unit 83 is changed due to deterioration and abrasion of the driving unit 83 upon use for a long period of time and the movement distance of the developing device 82 is changed, a constant developing leaf can not be maintained accordingly, whereby a problem of deterioration in the image quality occurs.

Still further, the high voltage switching equipment of the conventional developing device requires the motor 86 or the cam 84 necessary for movement of the developing device 82, and a sensor for sequentially driving color developing devices. Therefore, a problem that increases a manufacturing cost inevitably occurs.

SUMMARY OF THE INVENTION

An object of the invention is to solve at least the above and other problems and/or disadvantages and to provide at least the advantages described hereinafter.

Accordingly, an object of the present invention is to solve the foregoing and other problems by providing a high voltage switching equipment of a developing device for a color image forming apparatus capable of preventing deterioration in an image quality due to a load variation of a photoconductive drum which occurs in a conventional movement type developing device, and by adopting a fixed developing device type sequentially supplying a high voltage to each developing device.

Another object of the present invention is to provide a high voltage switching equipment of a developing device for a color image forming apparatus whose structure is simple, and which selectively supplies and switches a high voltage to each developing device, thereby achieving reduction in a manufacturing cost and improvement in reliability.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

The foregoing and other objects and advantages are achieved by providing a high voltage switching equipment of a developing device in a color image forming apparatus, which sequentially supplies a high voltage to color developing devices fixed on a frame of the color image forming apparatus to develop an electrostatic latent image formed on a photoconductive medium of the color image forming apparatus using color toner. The equipment includes high voltage applying terminals respectively formed in rear ends of the fixed color developing devices contacting the photoconductive medium, a high voltage applying substrate, within which a high voltage circuit is installed, and on which connector terminal strips connected to the each high voltage applying terminal is provided on one side, and on which first terminal strips connected to the high voltage circuit and second terminal strips connected to the connector terminal strips are arranged in pairs and spaced apart from each other by a constant distance, and a high voltage connecting unit connecting the first terminal strips and the second terminal strips arranged on the high voltage applying substrate, so that the high voltage is supplied to on a relevant developing device.

The high voltage connecting unit includes a contact member having a first and a second contact end portions corresponding to the first and the second terminal strips of the high voltage applying substrate, a holder supporting the contact member, and a holder moving member bringing the first and the second contact end portions into contact with the first and the second terminal strips selectively, by moving the holder back and forth with respect to the high voltage applying substrate.

Here, the contact member is a contact spring, and the holder moving member is a solenoid.

According to an aspect of the present invention, the connector terminal strips on the high voltage applying substrate and the high voltage applying terminal of the developing device, are closely connected by a spring connector.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
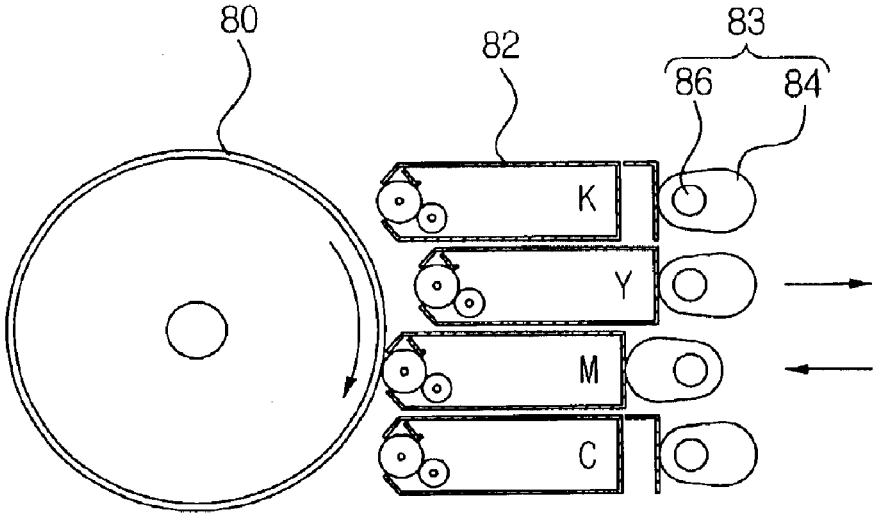
FIG. 1 (PRIOR ART)
FIG. 1 is a cross-sectional view schematically representing a high voltage switching equipment of a developing device adopted to a conventional color image forming apparatus.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

The following detailed description will present a high voltage switching equipment of a developing device according to a preferred embodiment of the invention in reference to the accompanying drawings.

Figure 2:
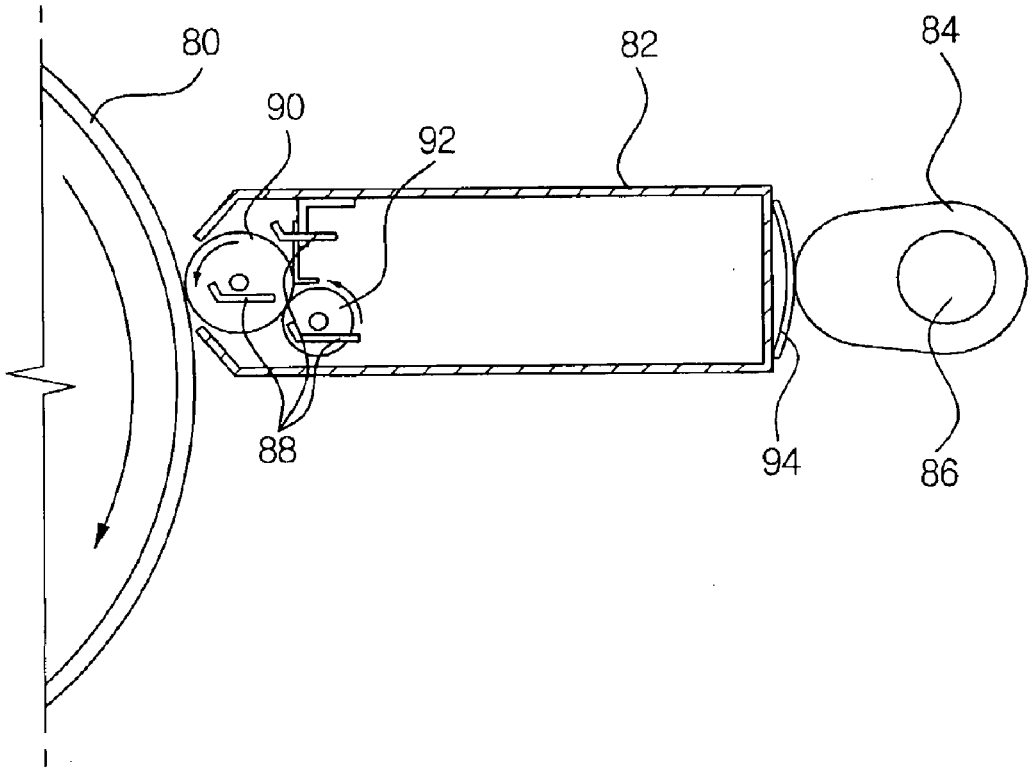
FIG. 2 (PRIOR ART)
FIG. 2 is an enlarged, cross-sectional view explaining a structure and an operation of the high voltage switching equipment of the developing device as shown in FIG. 1.
Figure 3:
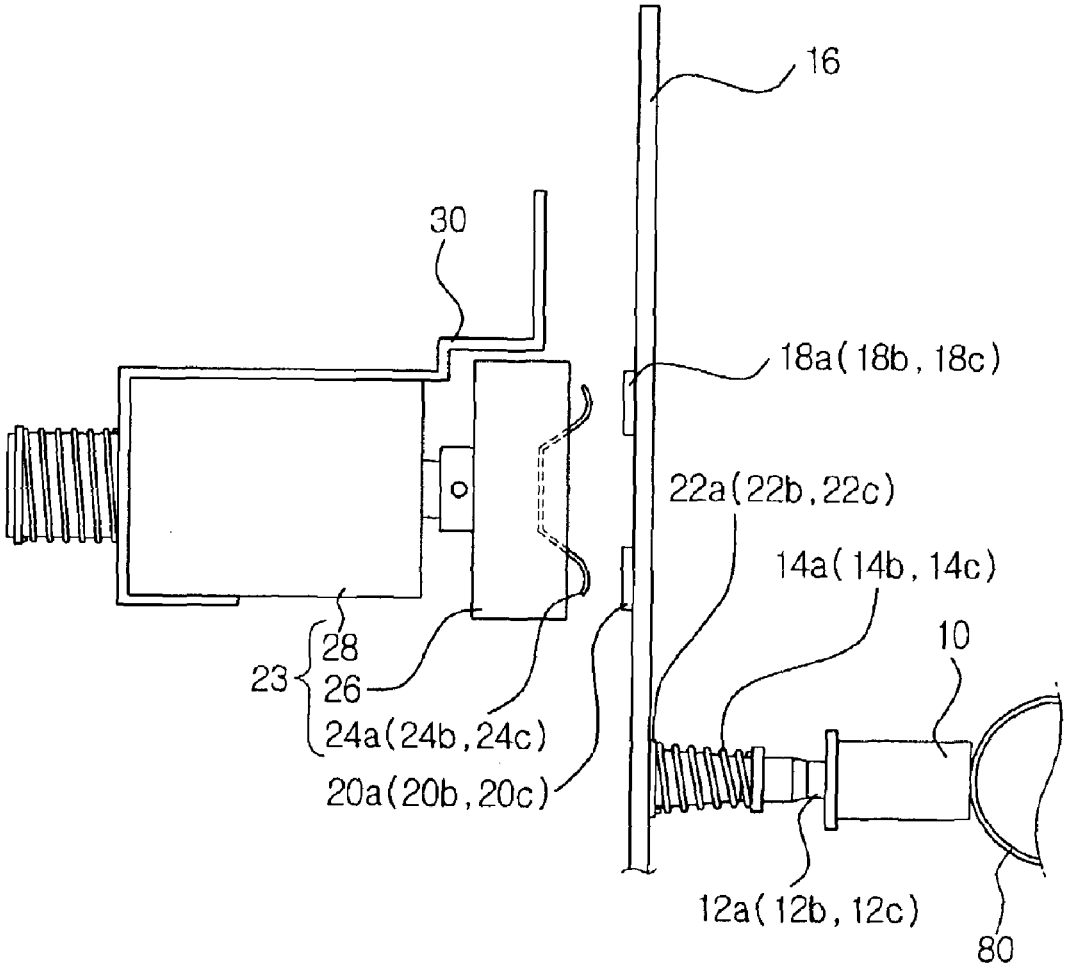
FIGS. 3 and 4 are drawings representing a status before and after a high voltage is supplied, in a high voltage switching equipment of a developing device for a color image forming apparatus according to one embodiment of the present invention.
Figure 4:
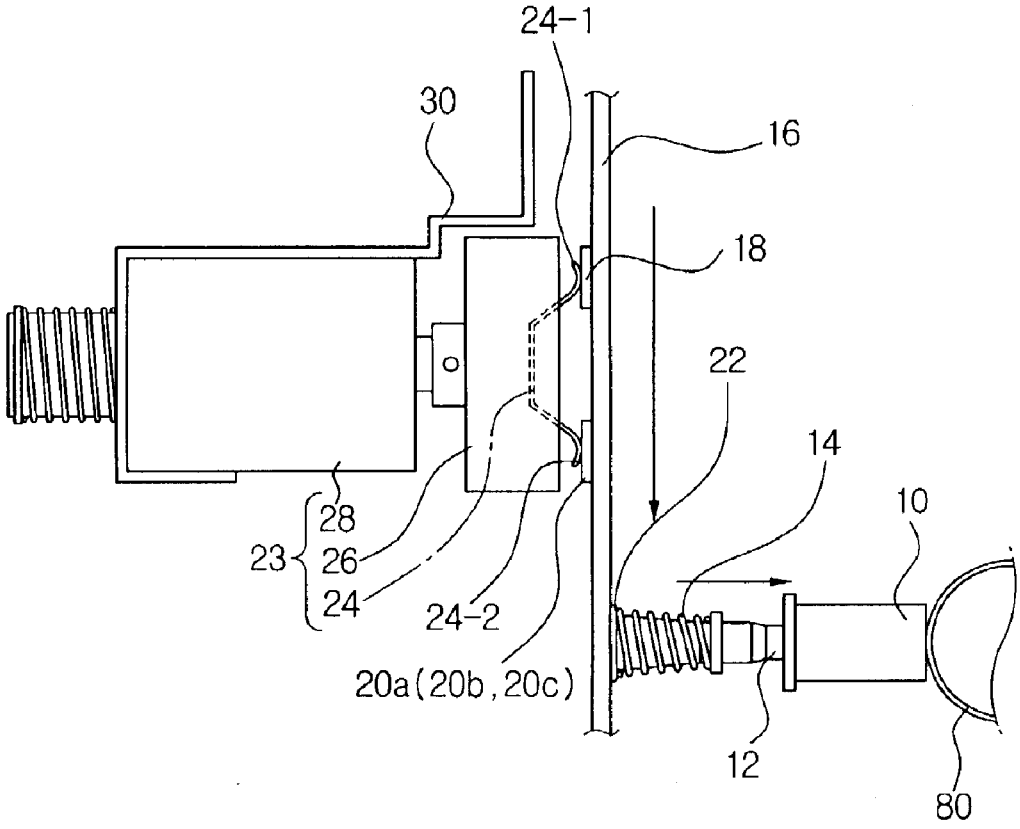
Figure 5:
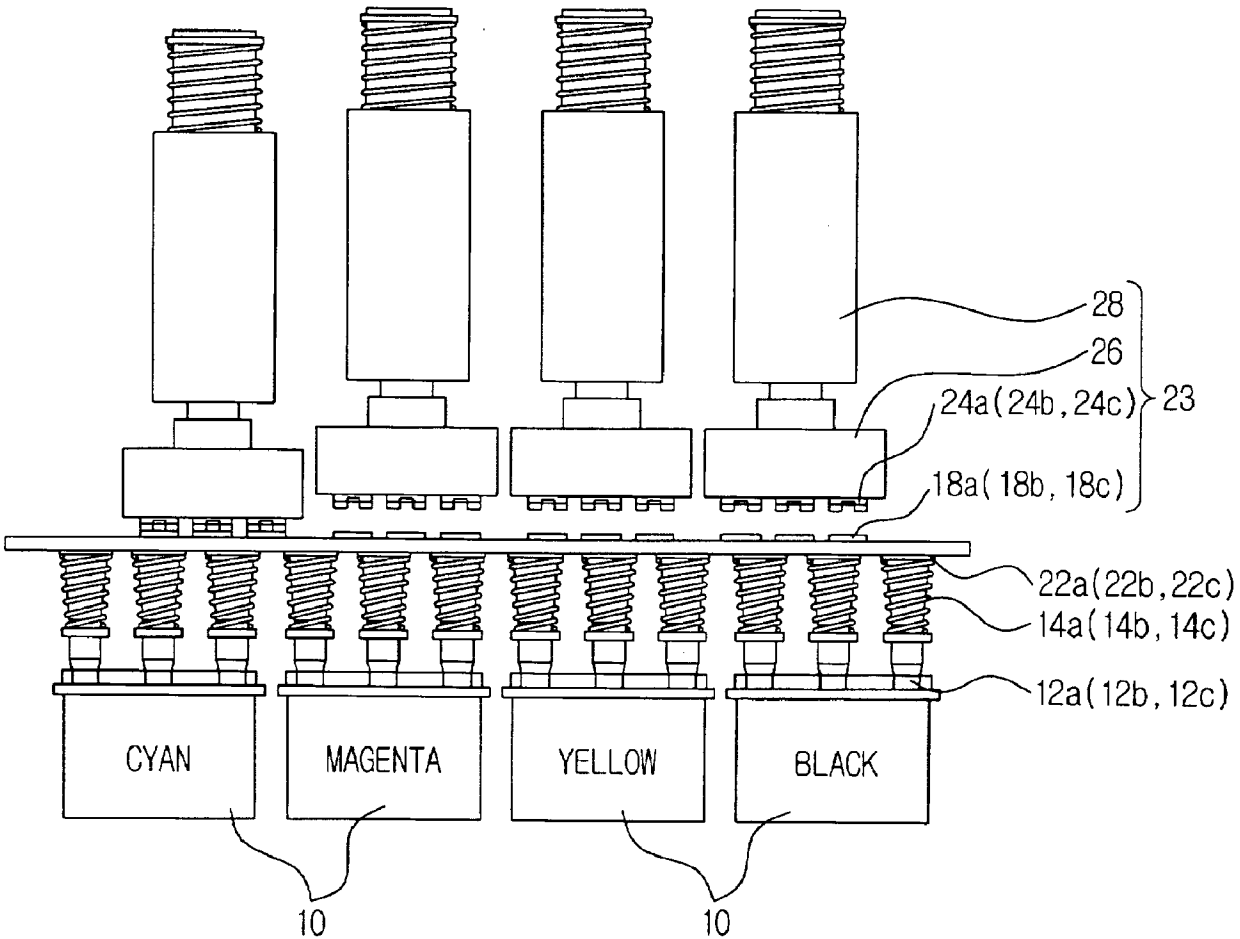
FIG. 5 is a plan view of the high voltage switching equipment of the developing device in a color image forming apparatus.

As shown in FIGS. 3 through 5, the high voltage switching equipment of the developing device for a color image forming apparatus according to an embodiment of the present invention, comprises developing devices 10, i.e., a yellow developing device, a magenta developing device, a cyan developing device, and a black developing device respectively fixed by a frame of the color image forming apparatus such that each developing device comes in contact with a photoconductive medium 80 with a constant developing nip. Here, each developing device 10 has a developing roller and a toner supplying roller as is the case of a conventional developing device (refer to FIG. 2).

A high voltage applying terminal 12 is formed in rear end portions of each developing device 10. In FIGS. 3 and 4, an example that three high voltage applying terminals 12*a*, 12*b*, 12*c* are formed for each developing device 10, is represented.

A high voltage applying substrate 16 is disposed in a rear side of each developing device 10. This high voltage applying substrate 16 includes a high voltage circuit and has a plurality of connector terminal strips 22 (22*a*, 22*b*, 22*c*) connected to a plurality of the high voltage applying terminals 12 (12*a*, 12*b*, 12*c*) on its one side, and has first terminal strips 18 (18*a*, 18*b*, 18*c*) and second terminal strips 20 (20*a*, 20*b*, 20*c*) which are formed in pairs and spaced-apart from each other by a constant distance, on its rear side. The first terminal strips 18 are connected to the high voltage applying circuit installed within the high voltage applying substrate 16, and the second terminal strips 20 are connected to the connector terminal strips 22, respectively.

Also, the high voltage applying terminals 12 and the connector terminal strips 22 are connected to each other by using spring connectors 14 (14*a*, 14*b*, 14*c*) disposed to be connected between the high voltage applying terminals 12 and the connector terminal strips 22.

A high voltage connecting unit 23 (as four high voltage connecting units are the same in their structure, description will be made only for one of the high voltage connecting units), is disposed on the rear side of the high voltage applying substrate 16 and comprises contact members 24 (24*a*, 24*b*, 24*c*), a holder 26 supporting the contact members 24 (24*a*, 24*b*, 24*c*), and a solenoid 28 moving back and forth the holder 26 with respect to the high voltage applying substrate 16.

The contact member 24 has first and a second contact end portions 24-1, 24-2 coming in contact with the first and the second terminal strips 18, 20, respectively. Accordingly, if the holder 26 is moved by the solenoid 28, that is, the holder 26 is moved forth, the first and the second contact end portions 24-1, 24-2 of the contact member 24 come into contact with the first and the second terminal strips 18, 20 of the high voltage applying substrate 16, so the first and the second terminal strips 18, 20 are connected electrically, whereby a high voltage could be supplied to a relevant developing device 10. For the contact member 24, a contact spring is preferably used, but there is no definite restriction to a material used for the contact member 24.

The solenoid 28 is one embodiment of a holder moving member moving the holder 26. For the holder moving member, not only the solenoid but also variety of embodiments are possible. In FIGS. 3 and 4, a reference numeral 30 represents a bracket supporting the solenoid.

An operation of the high voltage switching equipment of the developing device for a color image forming apparatus having the foregoing constitution according to the present invention, will be described hereinafter with reference to FIGS. 3 and 4.

FIG. 3 represents a status in which a power supply is not supplied to the solenoid 28, namely, a status in which a high voltage is not supplied to a relevant developing device 10. As is illustrated, the contact member 24 is moved back from the high voltage applying substrate 16, and the first and the second terminal strips 18, 20 on the high voltage applying substrate 16 are separated accordingly. Therefore, the high voltage is not supplied to the relevant developing device 10. In that case, the developing device 10 of FIG. 3 is in a status of non-development and only one of the three developing devices except that developing device 10 of FIG. 3 is in a status of development. Namely, to other developing devices 10 of FIG. 3 except the developing device 10 of FIG. 4 under a development status, the high voltage is not supplied as shown in a non-contact status of FIG. 3.

After that, when a turn comes for the developing device of FIG. 3 that was in the nondevelopment status, the power supply is applied to the solenoid 28, the holder 26 is moved forth to a side of the high voltage applying substrate 16. Accordingly, as shown in FIG. 4, the first and the second contact end portions 24-1, 24-2 of the contact member 24 supported by the holder 26 come into contact with the first and the second terminal strips 18, 20 of the high voltage applying substrate 16, whereby the first and the second terminal strips 18, 20 are connected electrically. Namely, as the high voltage circuit installed within the high voltage applying substrate 16 is electrically connected to the high applying terminal 12*a* (12*b*, 12*c*), the high voltage is supplied to the relevant developing device 10.

In the meantime, when development is completed for a relevant color by the developing device 10, the power supply for the solenoid 28 becomes off and, instead, the power supply is supplied to the solenoid 28 of other developing device 10, the development for other color is performed.

With the foregoing process performed repeatedly, an electrostatic latent image formed on the photoconductive medium, is developed into a visible color image. At the moment, in the foregoing development process, the high voltage is sequentially supplied to the color developing devices 10. Therefore, a problem of deterioration in image quality due to a load variation of the photoconductive medium 80 occurring in a conventional movement type developing device could be resolved.

As is apparent from the foregoing, according to the present invention, the high voltage switching equipment of a developing device which is a fixed type, is possibly constructed, and a change in rotational velocity and a change in a load of the photoconductive medium are not generated, so a stable image quality could be achieved accordingly.

Further, according to the present invention, elements, such as a motor or cam as was necessary in the conventional case, moving the developing device, could be eliminated, which makes it possible to construct the high voltage switching equipment of simple structure and to prevent a poor development, and a development interval between the developing device and the photoconductive medium is maintained almost constant.

Still further, for realization of the fixed type developing device, the solenoid is used for direct contact in order to supply the high voltage to the developing device, whereby a high voltage section through which the high voltage is transferred from the high voltage applying substrate to each developing device, could be minimized, and reliability for a high voltage contact point could be improved using a direct contact point.

Another still further, in an equipment supplying the high voltage to the developing device of four colors for realizing color printing, a high voltage control for each developing device could be constructed in a simply manner.

While the invention has been shown and described with reference to certain preferred embodiments thereof, it will be understood by those skilled in the art that various changes in form and details may be made therein without departing from the spirit and scope of the invention as defined by the appended claims and their equivalents.

Namely, a high voltage switching equipment according to the present invention, could be used not only for a color laser printer but also for a variety of printers, duplicating machines, and multifunction machines, etc., which require sequential control of voltage supplied to the developing device.

What is claimed is:

1. A high voltage switching equipment, which supplies a high voltage to color developing devices in a color image forming apparatus, to develop an electrostatic latent image formed on a photoconductive medium using color toner, the high voltage switching equipment comprising:

high voltage applying terminals respectively formed on the color developing devices which are fixed on a frame of the color image forming apparatus and contact the photoconductive medium through a nip;

a high voltage applying substrate, within which a high voltage circuit is installed, on which connector terminal strips connected to the each high voltage applying terminal are provided on one side, and on which first terminal strips connected to the high voltage circuit and second terminal strips connected to corresponding ones of the connector terminal strips are arranged in pairs and spaced-apart from each other by a constant distance; and a high voltage connecting unit connecting the first terminal strips and the second terminal strips arranged on the high voltage applying substrate, so that the high voltage is supplied to a relevant developing device.

2. The equipment according to claim 1, wherein the high voltage connecting unit comprises:

a contact member having a first and a second contact end portions corresponding to the first and the second terminal strips on the high voltage applying substrate;

a holder supporting the contact member; and a holder moving member selectively moving the holder with respect to the high voltage applying substrate to connect the first and the second contact end portions with the first and the second terminal strips.

3. The equipment according to claim 2, wherein the contact member comprises: a contact spring.

4. The equipment according to claim 2, wherein the holder moving member comprises:

a solenoid.

5. The equipment according to claim 1, wherein each color developing device comprises:

a spring connector connecting the connector terminal strips on the high voltage applying substrate to the high voltage applying terminal of the developing device.

6. A high voltage switching equipment in an image forming apparatus having a photoconductive medium, the high voltage switching equipment comprising:

a developing device unit developing an image formed on the photoconductive medium;

a high voltage applying terminal unit formed on the developing device unit;

a high voltage applying substrate unit comprising:

a substrate, a high voltage circuit included on the substrate, a first terminal strip connected to the high voltage circuit, and a second terminal strip connected to the high voltage applying terminal unit; and a high voltage connecting unit moving transverse with respect to the high voltage applying substrate to selectively connect the first terminal strip to the second terminal strip.

7. The equipment of claim 6, wherein the developing device unit and the high voltage applying substrate unit are stationary with respect to the photoconductive medium, and the high voltage connecting unit is movable with respect to one of the high voltage applying substrate unit and the developing device unit.

8. The equipment of claim 6, wherein:

the image forming apparatus comprises a frame, and the developing device unit comprises first, second, third, and fourth developing devices each disposed around a peripheral surface of the photoconductive medium and fixedly coupled to the frame to maintain a predetermined distance between the photoconductive medium and the developing device unit.

9. The equipment of claim 8, wherein the distance between the photoconductive medium and the first, second, third, and fourth developing devices is not variable, but constant.

10. The equipment of claim 8, wherein one of the first, second, third, and fourth developing devices does not move with respect to another one.

11. The equipment of claim 8, wherein the high voltage terminal unit comprises:

first, second, third, and fourth high voltage terminals formed on corresponding ones of the first, second, third, and fourth developing devices.

12. A high voltage switching equipment in an image forming apparatus having a photoconductive medium, the high voltage switching equipment comprising:

a developing device unit developing an image formed on the photoconductive medium;

a high voltage applying terminal unit formed on the developing device unit;

a high voltage applying substrate unit having a high voltage circuit, a first terminal strip connected to the high voltage circuit, and a second terminal strip connected to the high voltage applying terminal unit; and a high voltage connecting unit moving with respect to the high voltage applying substrate unit to selectively connect the first terminal strip to the second terminal strip, wherein:

the high voltage applying substrate unit comprises a first side and a second side, and the first terminal strip and the second terminal strip are formed on the first side of the high voltage applying substrate unit.

13. The equipment of claim 12, wherein the first side of the high voltage applying substrate unit faces the high voltage connecting unit, and the second side of the high voltage applying substrate unit faces the developing device unit.

14. The equipment of claim 12, wherein the high voltage applying substrate unit comprises:

a connector terminal strip formed on the second side and connected between the second terminal strip of the high voltage applying substrate unit and the high voltage applying terminal unit of the developing device unit.

15. The equipment of claim 14, wherein the high voltage applying substrate unit comprises:

a spring connector disposed between the high voltage applying substrate unit and the developing device unit to connect the connector terminal strip to the high voltage applying terminal of the developing device unit.

16. A high voltage switching equipment, which supplies a high voltage to a plurality of color developing devices in a color image forming apparatus, the high voltage switching equipment comprising:

a high voltage applying substrate comprising an input connected to the high voltage and a plurality of outputs, each output connected to a respective color developing device; and a plurality of high voltage connecting units, each of which moves transverse to the high voltage applying substrate to selectively connect and disconnect the input and a respective output of the high voltage applying substrate so that the high voltage is selectively supplied to the respective color developing device.

17. The equipment of claim 16, further comprising a high voltage applying terminal formed on a side of each color developing device and connected with the output of the high voltage applying substrate.

18. A high voltage switching equipment in a color image forming apparatus, which supplies a high voltage to color developing devices, the high voltage switching equipment comprising:

a high voltage applying substrate;

a high voltage applying terminal formed on a side of each color developing device and connected with the high voltage applying substrate;

a plurality of high voltage connecting units, each of which selectively connects and disconnects the high voltage applying substrate and a respective color developing device so that the high voltage is selectively supplied to the respective color developing device; and a plurality of pairs of first second terminals formed on a certain side of the high voltage applying substrate wherein each pair of terminals is connectable to selectively supply the high voltage to a respective one of the color developing devices.

19. The equipment of claim 18, further comprising a plurality of connector terminal strips formed on a side of the high voltage applying substrate opposite the certain side and connected with the second terminals, respectively.

20. The equipment of claim 19, further comprising a spring connector disposed between each connector terminal strip and a respective one of the high voltage applying terminals.

* * * * *

UNITED STATES PATENT AND TRADEMARK OFFICE

CERTIFICATE OF CORRECTION

PATENT NO. : 6,904,247 B2
DATED : June 7, 2005
INVENTOR(S) : Young-min Yoon et al.

It is certified that error appears in the above-identified patent and that said Letters Patent is hereby corrected as shown below:

Title page,
Item [75], Inventors, after "(KR)" insert -- Seung-yoon Lee, Suwon, (KR) --.

Column 8,
Line 54, after "first" insert -- and --.

Signed and Sealed this

Eleventh Day of April, 2006

JON W. DUDAS
*Director of the United States Patent and Trademark Office*